US011482807B2

(12) United States Patent
Wan et al.

(10) Patent No.: US 11,482,807 B2
(45) Date of Patent: Oct. 25, 2022

(54) WATERPROOF CONNECTOR AND MANUFACTURING METHOD THEREOF

(71) Applicant: LUXSHARE PRECISION INDUSTRY CO., LTD., Shenzhen (CN)

(72) Inventors: Wen Wan, Shenzhen (CN); Xiaobo Fu, Shenzhen (CN); Houtian Wu, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 16 days.

(21) Appl. No.: 17/038,707

(22) Filed: Sep. 30, 2020

(65) Prior Publication Data

US 2021/0119374 A1 Apr. 22, 2021

(30) Foreign Application Priority Data

Oct. 22, 2019 (CN) ..... 201911014409.8

(51) Int. Cl.
*H01R 13/52* (2006.01)
*H01R 12/75* (2011.01)
(Continued)

(52) U.S. Cl.
CPC ..... *H01R 13/521* (2013.01); *H01R 12/75* (2013.01); *H01R 13/405* (2013.01);
(Continued)

(58) Field of Classification Search
CPC ..... H01R 12/75; H01R 3/521; H01R 3/405; H01R 3/504; H01R 3/6275; H01R 43/18; H01R 43/20; H01R 43/24
See application file for complete search history.

(56) References Cited

U.S. PATENT DOCUMENTS 9,515,436 B2 * 12/2016 Kao ..... H01R 13/502
9,954,319 B2 * 4/2018 Zhao ..... H01R 13/10
(Continued)

FOREIGN PATENT DOCUMENTS

CN 206639959 U 11/2017
CN 107465058 A 12/2017
(Continued)

OTHER PUBLICATIONS

Partial translation of CN-207381615-U, published on May 18, 2018.
(Continued)

*Primary Examiner* — Oscar C Jimenez
(74) *Attorney, Agent, or Firm* — Birch, Stewart, Kolasch & Birch, LLP

(57) ABSTRACT

The present disclosure discloses a waterproof connector including an integral insulating body, a number of conductive terminals, and an insulating block. The insulating body includes a rear end portion, a front end portion, and a middle portion. The rear end portion defines a number of terminal grooves. The front end portion defines a mating space. The middle portion includes a receiving channel communicating with the terminal grooves. The terminals are disposed in the terminal grooves and extend towards the mating space. The insulating block is injection-molded in the receiving channel and seamlessly fixes the conductive terminals in the terminal grooves. The waterproof connector of the present disclosure can prevent water and dust from entering therein. A method of manufacturing the waterproof connector is also provided.

2 Claims, 6 Drawing Sheets

(51) Int. Cl.

| | |
|---|---|
| ***H01R 13/405*** | (2006.01) |
| ***H01R 13/504*** | (2006.01) |
| ***H01R 13/627*** | (2006.01) |
| ***H01R 43/18*** | (2006.01) |
| ***H01R 43/20*** | (2006.01) |
| ***H01R 43/24*** | (2006.01) |

(52) U.S. Cl.
CPC ..... *H01R 13/504* (2013.01); *H01R 13/6275* (2013.01); *H01R 43/18* (2013.01); *H01R 43/20* (2013.01); *H01R 43/24* (2013.01)

(56) References Cited

U.S. PATENT DOCUMENTS

| | | | | |
|---|---|---|---|---|
| 2015/0270659 | A1* | 9/2015 | Kao | H01R 24/64 439/607.01 |
| 2017/0070009 | A1* | 3/2017 | Chen | H01R 43/24 |
| 2017/0155216 | A1* | 6/2017 | Yao | H01R 13/5202 |
| 2021/0111508 | A1* | 4/2021 | Gu | H01R 43/24 |

FOREIGN PATENT DOCUMENTS

| | | | |
|---|---|---|---|
| CN | 206758685 | U | 12/2017 |
| CN | 207009715 | U | 2/2018 |
| CN | 207116802 | U | 3/2018 |
| CN | 207303499 | U | 5/2018 |
| CN | 207381615 | U | 5/2018 |
| CN | 207542469 | U | 6/2018 |
| CN | 207602848 | U | 7/2018 |
| CN | 207967425 | U | 10/2018 |
| CN | 109273912 | A | 1/2019 |
| CN | 208655970 | U | 3/2019 |
| CN | 109742593 | A | 5/2019 |
| CN | 208955308 | U | 6/2019 |
| CN | 209056648 | U | 7/2019 |
| TW | 201620210 | A | 6/2016 |
| TW | M556033 | U | 2/2018 |

OTHER PUBLICATIONS

Partial translation of CN-208655970-U, published on Mar. 26, 2019.

* cited by examiner

WATERPROOF CONNECTOR AND MANUFACTURING METHOD THEREOF

CROSS-REFERENCE TO RELATED APPLICATIONS

This patent application claims a priority of a Chinese Patent Application No. 201911014409.8 filed on Oct. 22, 2019, the entire content of which is incorporated herein by reference.

TECHNICAL FIELD

The present disclosure relates to a waterproof connector and a manufacturing method thereof, in particular to a connector with good waterproof performance and a manufacturing method thereof.

BACKGROUND

Connectors, as devices those connect two active devices and transmit current or signals, are widely used in electronic products. Due to rapid development of an electronics industry, the electronic product components are required lighter, thinner, and shorter, and also the connectors are required higher and higher performance. In order to improve stability of the internal components of connectors, a waterproof connector has been developed in the electrical connector industry to prevent both water and dust from entering into the electrical connector. A traditional Type-C connector includes a terminal module, a main insulating body, and a shielding shell. The terminal module includes an upper row of conductive terminals, an upper insulating body integrally formed with the upper row of conductive terminals by injection molding, a lower row of conductive terminals, a lower insulating body integrally formed with the lower row of conductive terminals by injection molding, and an intermediate grounding piece between the upper insulating body and the lower insulating body. After the upper insulating body, the lower insulating body and the intermediate grounding piece are assembled to be the terminal module, the main insulating body is injection-molded over the terminal module. The traditional Type-C connector has a segmented waterproof structure in which there is a first injection-molding process between two rows of terminals and two corresponding insulating bodies before assembling the two insulating bodies and then a second injection-molding process is needed after assembling the two insulating bodies. There is an assembly gap between the two insulating bodies and accordingly, waterproof performance is poor.

SUMMARY

An object of the present disclosure is to provide a connector having a good waterproof performance and a manufacturing method thereof.

In order to achieve the above object, the present disclosure discloses a waterproof connector including an integral insulating body, a plurality of conductive terminals, and an insulating block. The insulating body includes a rear end portion, a front end portion, and a middle portion connecting between the front end portion and the rear end portion. The rear end portion defines a plurality of terminal grooves. The front end portion defines a mating space. The middle portion defines a receiving channel recessed from an outer surface thereof. The receiving channel communicates with the terminal grooves. The terminals are disposed in the terminal grooves and extend towards the mating space. The insulating block is injection-molded in the receiving channel and seamlessly fixes the conductive terminals in the terminal grooves.

In order to achieve the above object, the present disclosure further discloses a waterproof connector including an injection-molded insulating body, a plurality of conductive terminals, an insulating block, and a metal shell. The insulating body defines a plurality of terminal grooves and a receiving channel outwardly exposed and inwardly communicating with the terminal grooves. The conductive terminals are partly disposed in the terminal grooves and partly exposed to the receiving channel. The insulating block is molded in the receiving channel by plastic injection or rubber injection and accordingly the conductive terminals are held in the terminal grooves by the insulating block. The metal shell is assembled outside the insulating body.

In order to achieve the above purpose, the present disclosure also discloses a method of manufacturing a waterproof connector including following steps:

step 1: injection-molding an insulating body during which an upper mold, a lower mold and a plurality of pin members are used for defining a receiving channel and a plurality of terminal grooves;

step 2: inserting a plurality of conductive terminals into the terminal grooves of the insulating body from a back-to-front direction; and step 3: injecting plastic or rubber into the receiving channel to form an insulating block.

Compared with the prior art, the present disclosure seals the gap between the conductive terminal and the insulating body and therefore, realizes effective waterproof performance.

DETAILED DESCRIPTION

Figure 1:
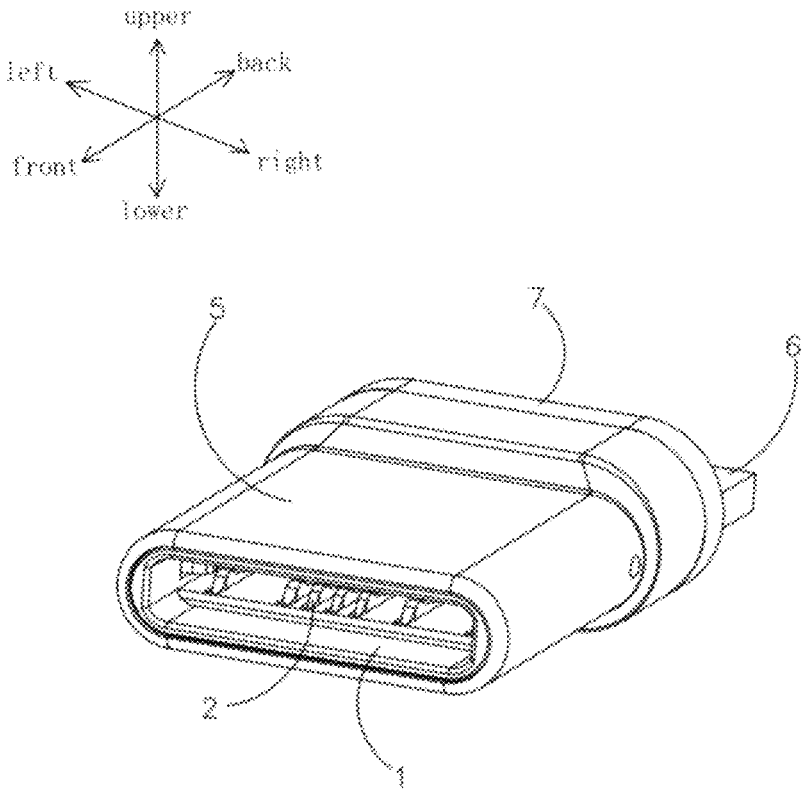
FIG. 1 is a perspective, assembled view of a waterproof connector in accordance with an embodiment of the present disclosure.
Figure 2:
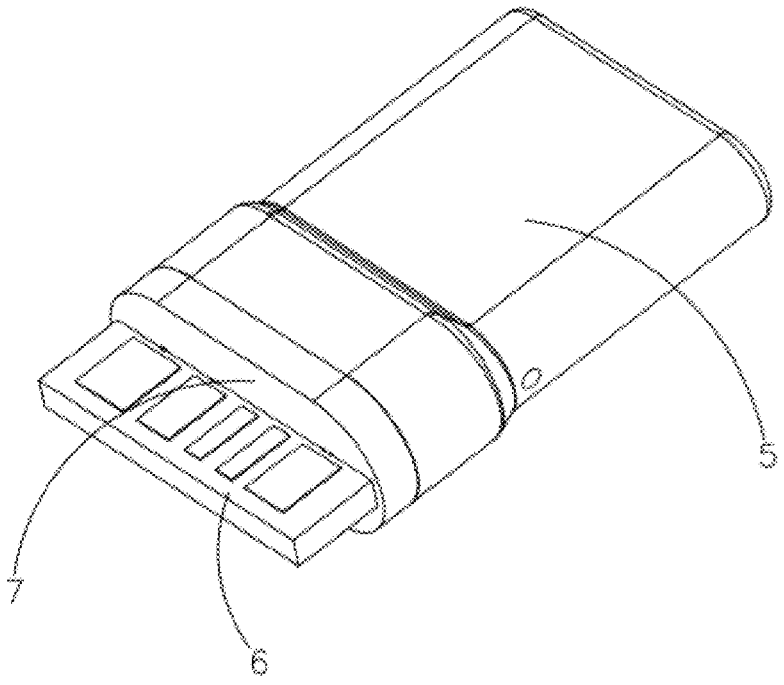
FIG. 2 is a perspective, assembled view of the waterproof connector of the present disclosure from another angle.

Referring to FIGS. 1 to 6, a waterproof connector in accordance with an illustrated embodiment of the present disclosure includes an insulating body 1 and a plurality of conductive terminals 2. The insulating body 1 is integrally injection-molded and includes a front end portion 11, a rear end portion 12 extending backwardly from the front end portion 11, and a middle portion (not labeled) connecting between the front end portion 11 and the rear end portion 12. The front end portion 11 defines a mating space 10. The rear end portion 12 defines a plurality of terminal grooves 14. The terminal grooves 14 are connected to and communicated with the mating space 10. The insulating body 1 is recessed from an outer surface of the middle portion to form an outwardly exposed receiving channel 13 for inwardly communicating with the terminal grooves 14. The conductive terminals 2 are inserted and assembled into the terminal grooves 14 along a back-to-front direction. Each conductive terminal 2 includes a contacting portion 21, a retaining portion 22, and a tail portion 23. The contacting portion 21 extends from the retaining portion 22 forwardly into the mating space 10. The tail portion 23 extends from the retaining portion 22 backwardly to be exposed outside the insulating body 1. The retaining portion 22 is partly disposed in the terminal groove 14 and partly exposed to the receiving channel 13. An insulating block 3 is injection-molded in the receiving channel 13 for integrally combining with the retaining portions 22 and so the retaining portions 22 are seamlessly and firmly held in the terminal grooves 14.

In a preferred embodiment of the present disclosure, the insulating block 3 is molded by plastic injection or rubber injection.

Figure 3:
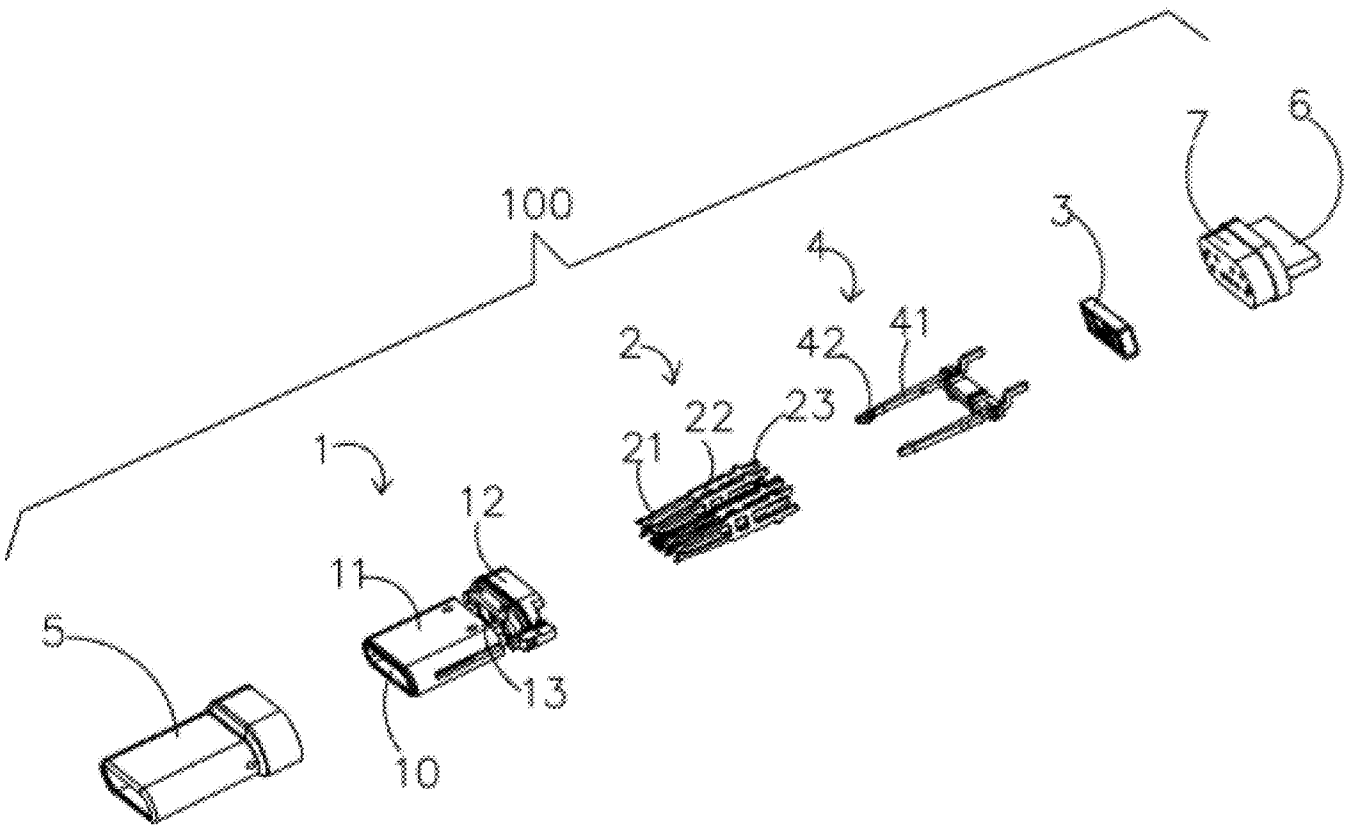
FIG. 3 is a perspective, exploded view of the waterproof connector of the present disclosure.
Figure 4:
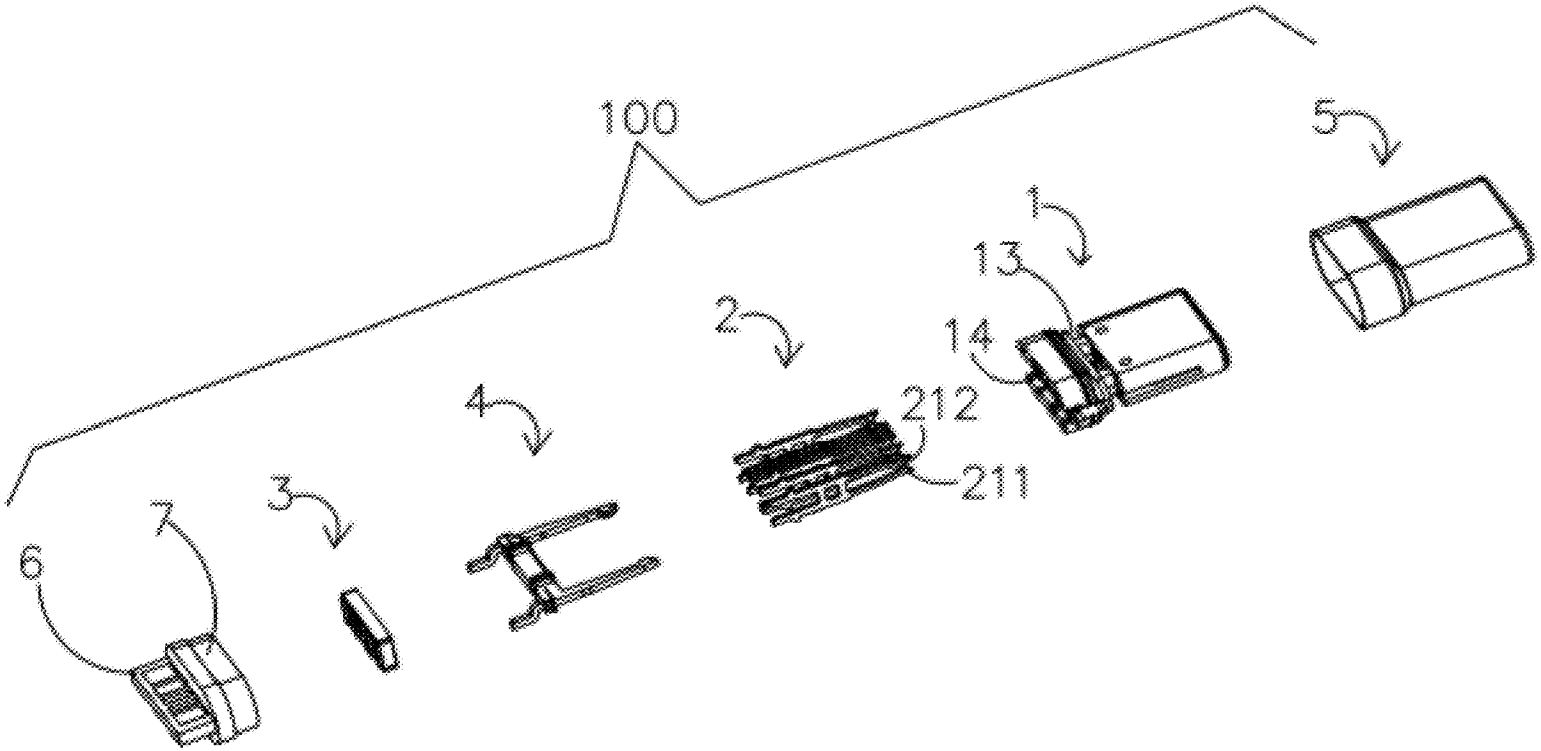
FIG. 4 is a perspective, exploded view of the waterproof connector of the present disclosure from another angle.
Figure 5:
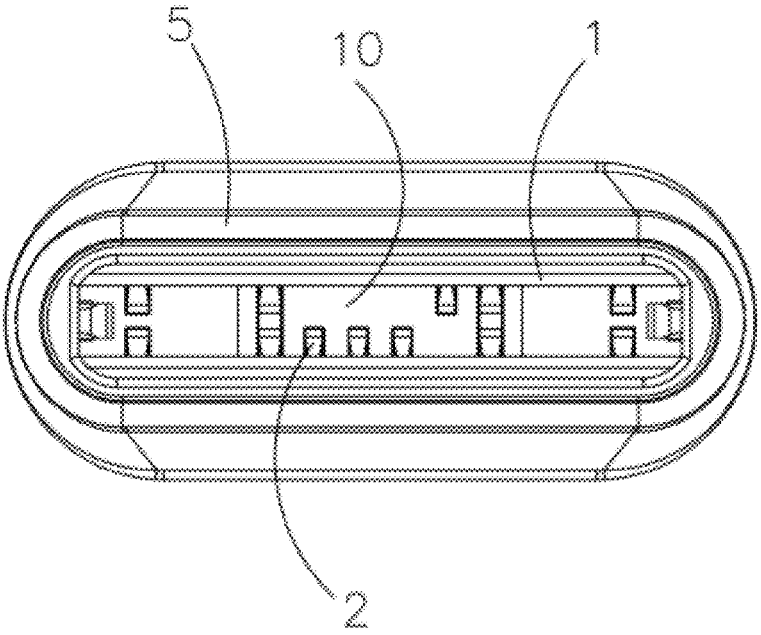
FIG. 5 is a front view of the waterproof connector of the present disclosure.
Figure 6:
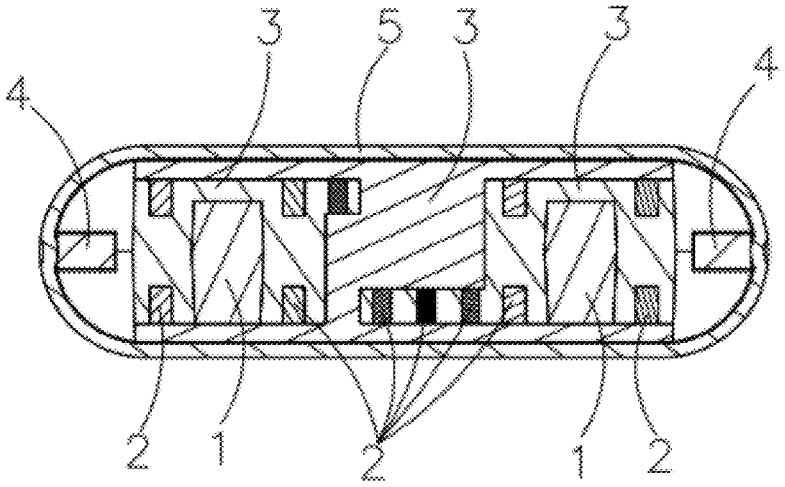
FIG. 6 is a cross-sectional view of the waterproof connector of the present disclosure along the insulating block.

Referring to FIGS. 3 to 5, each contacting portion 21 includes a first contacting portion 211 and a second contacting portion 212. The first contacting portions 211 are located above the mating space 10 and face downwardly towards the mating space 10. The second contacting portions 212 are located below the mating space 10 and face upwardly towards the mating space 10. The first contacting portions 211 and the second contacting portions 212 are respectively engaged with upper and lower opposite sides of a mating connector along an upper-and-lower direction when the mating connector is inserted into the mating space 10.

Referring to FIG. 3 and FIG. 4, the tail portions 23 are connected to a printed circuit board 6. In one embodiment of the present disclosure, the tail portions 23 are soldering portions so as to be soldered with the printed circuit board 6; in another embodiment of the present disclosure, the tail portions 23 are plug-in portions so as to be inserted into corresponding holes of the printed circuit board 6. Because the conductive terminals 2 are inserted into the insulating body 1 from the back-to-front direction when assembling, the present disclosure can be used for both the above-mentioned two types of conductive terminals 2 without adding additional processing steps.

Referring to FIG. 3 and FIG. 4, the waterproof connector further includes at least two locking beams 4 retained in the insulating body 1. Each locking beam 4 includes an elastic portion 41 and a heading portion 42 formed at a distal end of the elastic portion 41. The elastic portions 41 are located at the corresponding lateral sides of the insulating body 1. The heading portions 42 are located in the mating space 10 and face oppositely to each other along a left-and-right direction perpendicular to the upper-and-lower direction. The locking beams 4 are used for clamping with the mating connector in the left-and-right direction.

Referring to FIGS. 1 to 4, the waterproof connector further includes a metal shell 5 assembled outside the insulating body 1. The elastic portions 41 of the locking beams 4 are sandwiched between the insulating body 1 and the metal shell 5. The metal shell 5 has a shielding function to prevent external signal interference.

The present disclosure also relates to a method of manufacturing a waterproof connector, which includes the following steps:

step 1: injection-molding the insulating body 1. During the injection molding process, an upper mold (not shown), a lower mold (not shown) and a plurality of pin members (not shown) are used when forming the insulating body 1. The upper mold and the lower mold are withdrawn from the insulating body 1 along an upper-and-lower direction for defining the receiving channel 13 and the pin members are withdrawn from the insulating body 1 along a front-and-back direction for defining the terminal grooves 14. After withdrawing the upper mold, the lower mold, and the pin members, the terminal grooves 14 are communicated with the receiving channel 13;

step 2: inserting a plurality of conductive terminals 2 into the terminal grooves 14 of the insulating body 1 from a back-to-front direction;

step 3: injecting plastic or rubber into the receiving channel 13 to form the insulating block 3.

In the step 2 of the present disclosure, the locking beams 4 are inserted into the insulating body 1 from the back-to-front direction as same as the conductive terminals 2.

In a preferred embodiment of the present disclosure, it also includes a step 4 after the step 3: assembling the metal shell 5 outside the insulating body 1.

In a preferred embodiment of the present disclosure, it also includes a step 5 after the step 4: connecting the conductive terminals 2 and the printed circuit board 6 to the insulating body 1 and thereafter injection-molding to form a baffle 7 between the insulating body 1 and the printed circuit board 6.

The present disclosure has an integrally injection-molded insulating body 1 with no so-called assembly gap between the upper insulating body and the lower insulating body as described in the prior art. The conductive terminals 2 are inserted and assembled into the integral insulating body 1, and thereafter, the insulating block 3 is injection-molded into the receiving channel 13 of the insulating body 1, and so that the gap between the conductive terminals 2 and the insulating body 1 is sealed, i.e., the waterproof connector of the present disclosure can prevent water and dust from entering therein.

The above embodiments are only used to illustrate the present disclosure and not to limit the technical solutions described in the present disclosure. The understanding of this specification should be based on those skilled in the art. Descriptions of directions, such as "front", "back", "left", "right", "upper" and "lower", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A method of manufacturing a waterproof connector comprising following steps:

step 1: injection-molding an insulating body during which an upper mold, a lower mold and a plurality of pin members are used for defining a receiving channel and a plurality of terminal grooves;

step 2: inserting a plurality of conductive terminals into the terminal grooves of the insulating body from a back-to-front direction;

step 3: injecting plastic or rubber into the receiving channel to form an insulating block;

step 4: assembling a metal shell outside the insulating body; and step 5: connecting the conductive terminals to a printed circuit board and thereafter injection-molding a baffle between the insulating body and the printed circuit board.

2. The method according to claim 1, wherein at least two locking beams are inserted into the insulating body from the back-to-front direction together with the conductive terminals in the step 2.

* * * * *